US008205954B2

(12) United States Patent
Terada

(10) Patent No.: US 8,205,954 B2
(45) Date of Patent: Jun. 26, 2012

(54) IMAGE RECORDING APPARATUS AND IMAGE RECORDING METHOD

(75) Inventor: Kohei Terada, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 380 days.

(21) Appl. No.: 12/395,325

(22) Filed: Feb. 27, 2009

(65) Prior Publication Data

US 2009/0219322 A1 Sep. 3, 2009

(30) Foreign Application Priority Data

Feb. 29, 2008 (JP) ..... 2008-051389

(51) Int. Cl.
*B41J 29/38* (2006.01)
*B41J 29/393* (2006.01)
*B41J 2/01* (2006.01)

(52) U.S. Cl. ..... 347/16; 347/19; 347/101; 347/104; 347/105

(58) Field of Classification Search ..... 347/16, 347/19, 101, 104–105
See application file for complete search history.

(56) References Cited

U.S. PATENT DOCUMENTS

| | | | | |
|---|---|---|---|---|
| 5,975,666 | A | 11/1999 | Kawaguchi | |
| 2008/0192270 | A1 | 8/2008 | Nakano et al. | |
| 2008/0198195 | A1 * | 8/2008 | Matsumura | 347/16 |

FOREIGN PATENT DOCUMENTS

| | | | |
|---|---|---|---|
| JP | H02-235752 | A | 9/1990 |
| JP | H03-161378 | A | 7/1991 |
| JP | H07-117296 | A | 5/1995 |
| JP | 2004-148733 | A | 5/2004 |
| JP | 2004-224005 | A | 8/2004 |
| JP | 2008-044325 | A | 2/2008 |

OTHER PUBLICATIONS

Japan Patent Office; Notification of Reason for Refusal for Patent Application No. 2008-051389, dispatched Jan. 5, 2011.
Japan Patent Office, Notification of Reason for Refusal for Application No. JP2008-051389, mailed Aug. 3, 2010.

* cited by examiner

*Primary Examiner* — Jason Uhlenhake
(74) *Attorney, Agent, or Firm* — Baker Botts L.L.P.

(57) ABSTRACT

An image recording apparatus includes a feeding device which feeds a recording medium based on a target feed amount, a recording device which records an image on the recording medium that is fed by the feeding device, a feed-amount correcting portion which corrects the target feed amount, and a recording-position adjusting portion which adjusts a first position in which an image recording is initiated on the recording medium, corresponding to a correction of the target feed amount by the feed-amount correcting portion.

13 Claims, 10 Drawing Sheets

IMAGE RECORDING APPARATUS AND IMAGE RECORDING METHOD

CROSS REFERENCE TO RELATED APPLICATION

The present application claims priority from Japanese Patent Application No. 2008-61389, which was filed on Feb. 29, 2008, the disclosure of which is herein incorporated by reference in its entirety.

BACKGROUND OF THE INVENTION

1. Field of the Invention

The present invention relates to an image recording apparatus and an image recording method in which a recording medium is fed by a feeding device based on a target feed amount and an image is recorded on the recording medium by a recording device. In particular, the present invention relates to the image recording apparatus and the image recording method in which the target feed amount is corrected.

2. Discussion of Related Art

There has been known an inkjet printer as an image recording apparatus which records an image on a recording sheet as a recording medium while the recording medium is intermittently fed. In the inkjet printer, a pair of rollers that are opposed to each other cooperate with each other to nip the recording sheet and feed onto a platen. When the recording sheet reaches the platen, the pair of rollers are intermittently rotated and driven by a predetermined feed amount. When the pair of rollers are temporarily stopped and the recording sheet is stopped on the platen, a recording head (a printhead) is reciprocated while the recording head is ejecting droplets of ink toward the recording sheet. The droplets of ink which are selectively ejected from the recording head are landed on the recording sheet such that a desired image is formed on the recording sheet. Because the above-mentioned operation is repeatedly performed, an image recording is sequentially performed from a top end or a leading end of the recording sheet to a bottom end or a trailing end thereof.

In the above-mentioned printer, a problem which is called "banding" may occur in a recorded image on the recording sheet. The banding is sometimes referred to as "white banding" or "stripe of light color", or "black banding" or "stripe of dark color". Although there are various causes of "banding", one of the causes is due to extension or contraction (expansion or contraction) of the recording sheet. In the inkjet printer, it is known that the recording sheet is elongated or contracted when droplets of ink are landed on and permeated into the recording sheet. An amount of the extension or contraction of the recording sheet differs in a grain (fiber) direction in the sheet. In general, a sheet in which the grain direction is a lengthwise (longitudinal) direction or a machine direction of a cut sheet is referred to as "a machine-direction oriented sheet", and a sheet in which the grain direction is a cross direction of the cut sheet along a short side thereof is referred to as "a cross-direction oriented sheet". In a case where an image recording is performed such that the recording sheet is fed in the lengthwise direction of the recording sheet, it is generally mentioned that an amount of extension due to ink permeation of the cross-direction oriented sheet is larger than that of the machine-direction oriented sheet.

In the inkjet printer, in a case where the image recording is performed, e.g., in such a manner of interlacing, an area of the recording sheet on which the ink droplets are landed is extended, while another area of the recording sheet in which the image recording is not performed and in which a pair of feed rollers nip the recording sheet is not extended. In a case where the ink droplets are landed on a portion of the recording sheet corresponding to a portion between each pitch of a plurality of nozzles of the recording head in order to record an image of high resolution on the recording sheet, the recording sheet is fed by the feed rollers based on a feed amount depending on the pitch of the nozzles and a desired resolution. Since the area of the recording sheet on which the ink droplets are ejected from the recording head is extended, the ink droplets are landed in a position of the recording sheet that is located out of alignment with a targeted position thereof. Therefore, the banding occurs in the recorded image on the recording sheet.

Japanese Patent No. 2,786,234 (Patent Document 1) discloses that, as a volume of ink that is ejected from a recording head becomes larger, an amount of movement of the recording sheet relative to the recording head is controlled to become larger.

In Patent Document 1, the banding is reduced, but the amount of movement of the recording sheet relative to the recording head becomes larger, so that a recorded image on the recording sheet is stretched longer in a direction of movement of the recording sheet relative to the recording head. In a case where an image is recorded on a roll paper as the recording sheet as disclosed in Patent Document 1, the recording sheet can be elongated enough to correspond to the stretched image. In a case where an image is recorded on a cut sheet as the recording sheet, such problems occur that a margin of a bottom end of the recording sheet comes to be small or that a part of the image cannot be recorded on the recording sheet.

In a case where the feed amount of the recording sheet is made smaller when the recording sheet is contracted, for example, in a borderless printing on a cut sheet, a length of an image that is recorded on the cut sheet as the recording sheet becomes smaller, so that a margin is formed on a side of the bottom end of the recording sheet.

SUMMARY OF THE INVENTION

In the light of the above-described technical background, the present invention has been developed. It is therefore an object of the present invention to provide an image recording apparatus and an image recording method which restrain that, even when a target feed amount of the recording sheet is corrected corresponding to the extension or contraction of the recording sheet, a margin provided in a bottom end portion of a recording medium or an amount of protrusion out of a bottom edge of a recording medium cannot be controlled or a part of the image cannot be recorded on the recording medium.

According to the present invention, there is provided an image recording apparatus comprising: a feeding device which is configured to feed a recording medium based on a target feed amount, the recording medium having a first length in a feed direction; a recording device which is configured to record an image on the recording medium that is fed by the feeding device; a feed-amount correcting portion which is configured to correct the target feed amount; and a recording-position adjusting portion which is configured to adjust a first position in which an image recording is initiated on the recording medium, corresponding to a correction of the target feed amount by the feed-amount correcting portion.

An inkjet printer is one embodiment of the image recording apparatus. In the image recording apparatus, the recording medium is fed in the feed direction by the feeding device and an image is recorded on the recording medium by the recording device. The recording medium has the first length in the feed direction and the image recording is initiated on the recording medium at the first position thereof and is sequentially performed on the recording medium toward an upstream side thereof in the feed direction or a bottom end thereof. In a case where a margin is provided in a downstream side of the recording medium in the feed direction or a top end portion thereof, the first position is defined as a position that is apart from the top end thereof toward the bottom end thereof by the margin. Further, in a case of a borderless printing in which no margin is provided on a side of the top end of the recording medium, the first position is defined as a position that shifts or protrudes outward from the top end of the recording medium. That is, in the borderless printing, a part of a recorded image on the top end of the recording medium protrudes outside of the recording medium. Accordingly, an image is recorded on the recording medium without a margin.

In the present invention, the feed direction is defined as a direction in which the recording medium is fed in the image recording. Further, in the present invention, the margin is defined as an area in which a ground of the recording medium is remained without performing of the image recording in a periphery of the recording medium. In a case where the amount of protrusion in the borderless printing is considered as a negative amount of margin, a similar function and effect in the present invention can be enjoyed.

There is a case where the target feed amount is corrected by the feed-amount correcting portion. For example, in a case where the image recording is performed on a recording sheet as the recording medium by the inkjet recording device, when ink is permeated into the recording sheet, the recording sheet happens to be extended or contracted, compared to the recording sheet in a dry condition before the image recording is performed. The extension or contraction of the recording sheet causes the banding in the recording sheet. In order to restrain the banding, the target feed amount is corrected so as to increase or decrease the target feed amount by a predetermined rate corresponding to an expected amount of the extension or contraction of the recording sheet.

More precisely, while a part of area of the recording sheet in which ink droplets are ejected from the recording device is extended or contracted, another part thereof is not extended or contracted at a nip position where the feeding device nips the recording sheet and where the image recording is not performed. Further, for example, in a case where the feeding device feeds the recording sheet by the target feed amount corresponding to respective pitches between a plurality of nozzles of the recording device in order that the ink droplets are landed on an area of the recording sheet that is located between the pitches in a manner of interlacing, in the part of area of the recording sheet in which the extension or contraction occurs, a landing position of the ink droplets is displaced or shifted by an amount of the extension or contraction. Moreover, in an image recording area by the recording device, an amount of the ink droplets that are landed on the area between the pitches of the nozzles on the downstream side of the recording sheet in the feed direction is larger, on the other hand, the amount of the ink droplets is smaller on the upstream side thereof in the feed direction. In other words, the amount of the extension or contraction of the recording sheet differs in the image recording area by the recording device. Therefore, even when the target feed amount is corrected in order to restrain the banding, it is impossible in principle to correct the target feed amount such that the target feed amount is completely in accordance with the amount of extension or contraction of the recording sheet. Thus, for example, a degree of the banding is reduced in such manners that the target feed amount is corrected by a substantially half of the amount of or contraction such that a shift in a portion of the recording sheet that is extended or contracted is compensated for a portion thereof that is not extended or contracted, or the target feed amount is corrected in consideration for a difference in the amount of extension or contraction in the image recording area. The above-mentioned correction of the target feed amount may be adjusted, depending on kinds (sorts) of the recording sheet or a characteristic of extension or contraction of the recording sheet, as mentioned later, or depending on a volume of ink landed on the recording sheet.

The above-mentioned correction of the target feed amount in the present invention is differentiated from a correction of a target feed amount that is performed, for example, in a case where the feeding device includes a feed roller, in consideration of an error of an outside diameter of the feed roller and so on. Accordingly, the correction of the target feed amount in the present invention is an ideal feed amount that is determined base on a resolution of a recorded image and so forth. In addition to the correction of the target feed amount in the present invention, the correction of the target feed amount in consideration of an error of the outside diameter of the feed roller may also be performed.

The recording-position adjusting portion adjusts the first position corresponding to the above-mentioned correction of the target feed amount. For example, in a case where the target feed amount is increased by the feed-amount correcting portion, a recorded image on the recording medium is longer in the feed direction than a length of an image that is recorded on the recording medium that is fed by the feeding device based on the target feed amount before the correction is performed. In a case where margins are provided on the downstream side, and the upstream side of the recording medium in the feed direction, the first position is adjusted such that the margin on the downstream side is decreased. Therefore, an increased length of the image that is recorded on the recording medium in the feed direction by the feed-amount correcting portion is absorbed or compensated by not only the margin on the upstream side of the recording medium but the margin on the downstream side thereof. In other words, in the recording medium after a recording operation is performed, the recorded image is extended to the respective margins on the downstream side and the upstream side of the recording medium in the feed direction. Accordingly, it is restrained that only the margin on the upstream side of the recoding medium is decreased, or that an upstream side of the image in the feed direction or a bottom end portion of an image is not recorded on the recording medium.

In a case where the target feed amount is decreased by the feed-amount correcting portion, the recorded image on the recording medium is smaller than a length of the image that is recorded on the recording medium that is fed by the feeding device based on the target feed amount before the correction is performed. For example, in the borderless printing, the first position is adjusted such that an amount of print that protrudes from a top edge of the recording medium or the negative amount of margin is decreased. Therefore, a decreased length of the image in the feed direction is absorbed or compensated by not only a protruding portion on the bottom end of the recording medium but also a protruding portion on the top end thereof. Accordingly, it is restrained that a margin is provided on the bottom end of the recording medium or on the upstream side thereof in the feed direction.

The recording-position adjusting portion may adjust the first position, based on a difference between a second length of the image in the feed direction that is recorded on the recording medium in a case where the recording medium is fed by a feed amount in accordance with the target feed amount and a third length of the image in the feed direction that is recorded on the recording medium in a case where the recording medium is fed by the corrected feed amount.

When the target feed amount is corrected by the feed-amount correcting portion, the feed amount of the recording medium is increased or decreased. As a result, a length of the recorded image in the feed direction is extended or contracted. This amount of extension or contraction is the difference between the second length of the image in the feed direction that is recorded on the recording medium in the case where the recording medium is fed by the feed amount in accordance with the target feed amount and the third length of the image in the feed direction that is recorded on the recording medium in the case where the recording medium is fed by the corrected feed amount. Since the first position is adjusted based on the difference between the second length and the third length, the extension or the contraction of the image is absorbed or compensated by the downstream side and the upstream side of the recording medium in the feed direction.

It is desirable that an adjusted amount of the first position by the recording-position adjusting portion is a half of the difference between the second length and the third length.

The feed-amount correcting portion may determine the corrected amount of the target feed amount based on kinds of the recording medium.

The kinds of the recording medium include, in a case where the recording medium is made of a paper, a kind of paper and an existence of coating thereon, and a difference between the machine-direction oriented sheet and the cross-direction oriented sheet in a case where the recording media are made of a material of the same kind. As the kinds of the recording medium differ, the amount of extension or contraction of the recording medium due to the ink permeation also differs. In other words, the characteristic of extension or contraction varies depending on the kinds of the recording medium. Therefore, in a case where the image recording is performed on the recording medium of a kind having a relatively large amount of extension or contraction, the corrected amount of the target feed amount may be made larger. In a case where the image recording is performed on the recording medium of a kind having a relatively small amount of extension or contraction, the corrected amount of the target feed amount may be made smaller or the target feed amount may not be corrected. In addition to the kinds of the recording medium, the corrected amount of the target feed amount may be determined depending on a volume of ink that is landed on or received by the recording medium.

The feeding device may intermittently feed the recording medium by the target feed amount, and the recording device may record the image on the recording medium while feeding of the recording medium by the feeding device is stopped.

In the image recording apparatus, the feeding device may intermittently feed the recording medium in the feed direction by the target feed amount. While the feeding of the recording medium is stopped, the recording device records the image on the recording medium in a direction perpendicular to the feed direction. Thus, an intermittent feeding and an image recording are alternately performed, so that the image is sequentially from a top end of the recording medium to a bottom end thereof. For example, in a case where the extension or contraction of the recording medium occurs due to the ink permeation, the extension or contraction occurs in a portion of the recording medium in which the image recording is performed. Therefore, by correcting of the target feed amount corresponding to the extension or contraction, a banding caused by the extension or contraction in the portion of the recording medium can be restrained.

In the present invention, there may be provided an image recording method in which, in a first position that is located in a downstream side of a recording medium in a feed direction, an image recording is initiated on the recording medium that is fed in the feed direction based on a target feed amount and has a first length in the feed direction, wherein the target feed amount is corrected and the first position is adjusted corresponding to a correction of the target feed amount.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Hereinafter, there will be described preferred embodiments of the present invention by reference to the drawings. In the present embodiment, a multi-function device (MFD) 10 is described as an embodiment of an image recording apparatus to which the present invention is applied. However, the present invention is not limited to the present embodiment. It is to be understood that the present invention may be embodied with various changes and modifications that may occur to a person skilled in the art, without departing from the spirit and scope of the invention defined in the appended claims.

Figure 1:
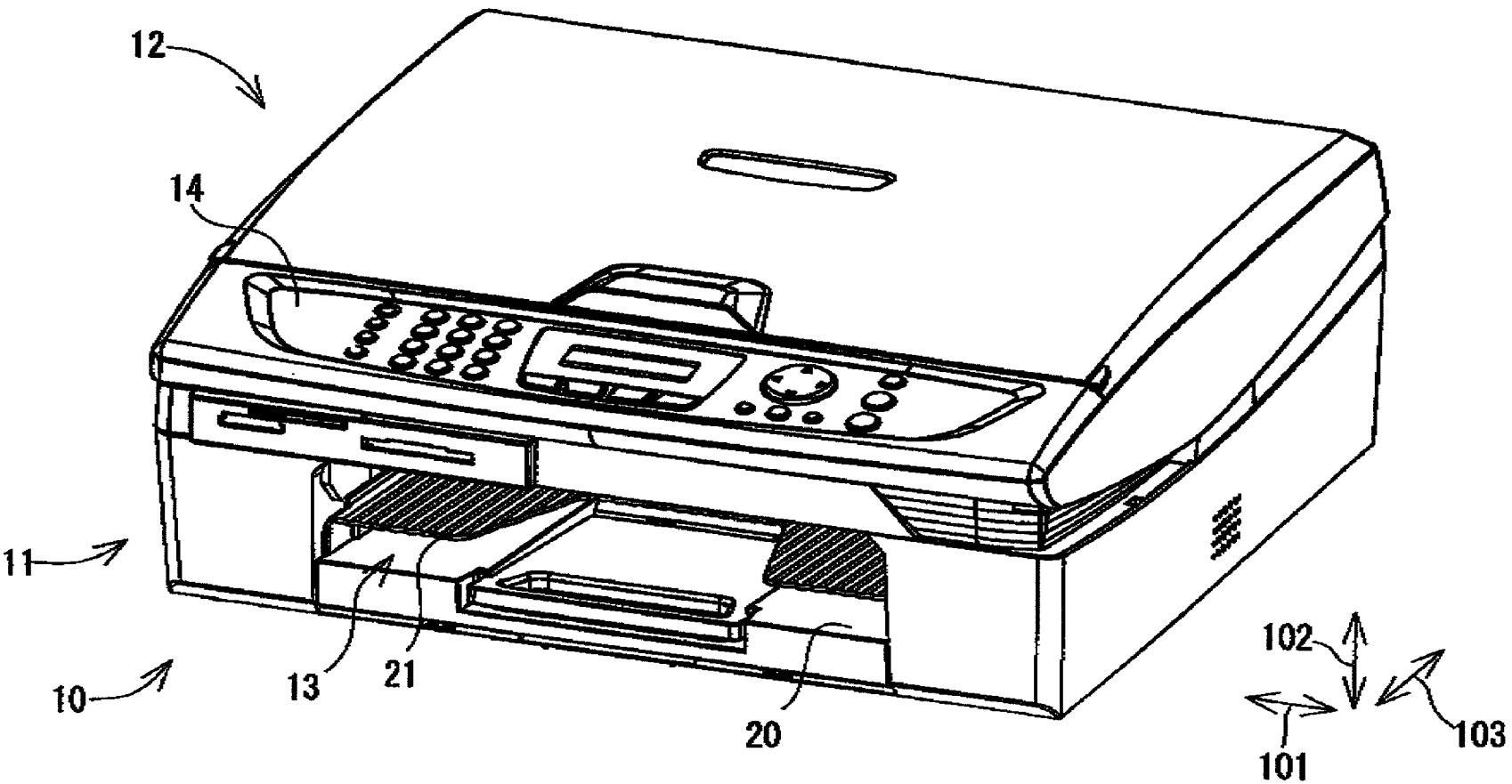
FIG. 1 is a perspective view of a multi-function device (MFD) in an embodiment to which the present invention is applied.
Figure 2:
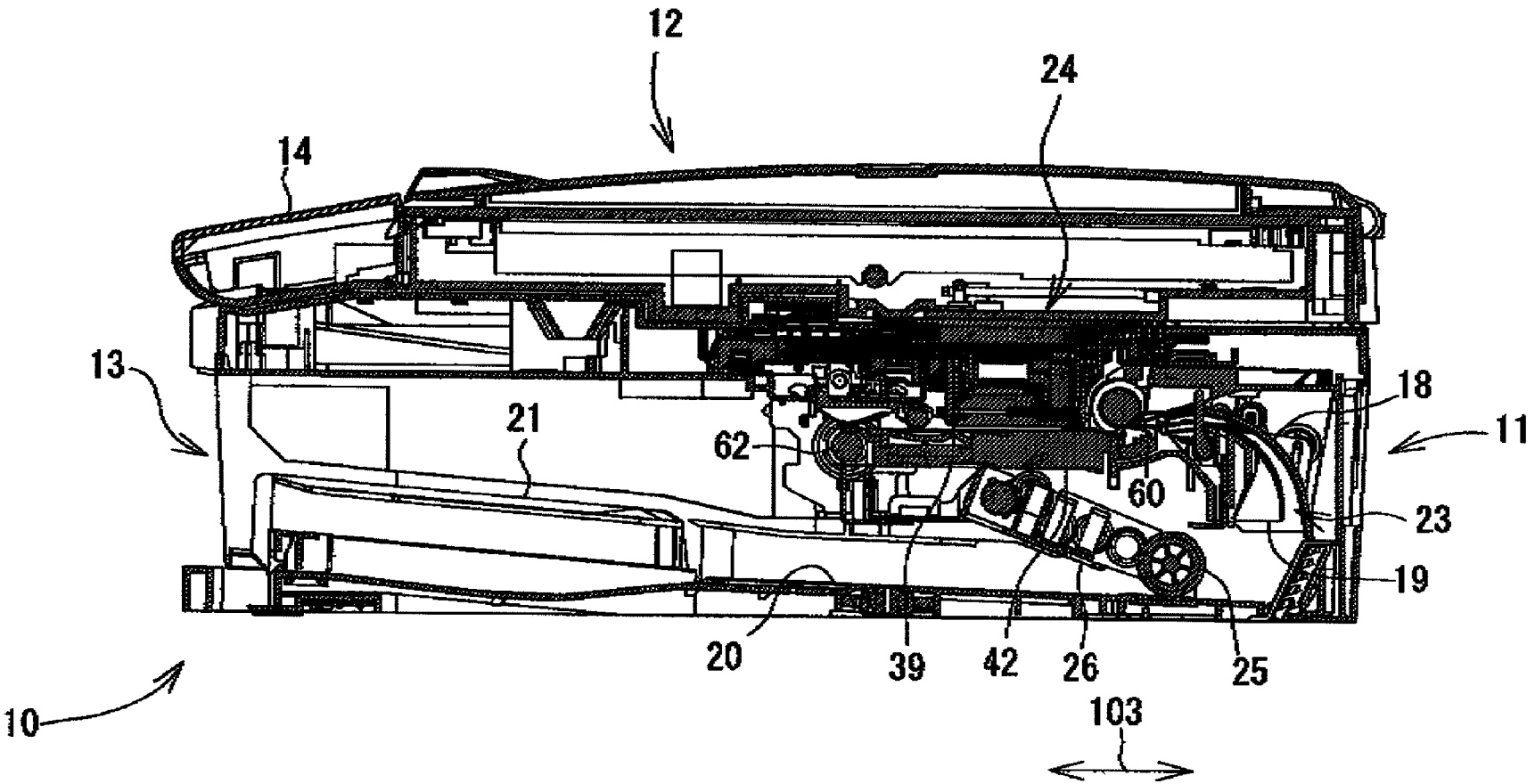
FIG. 2 is a side elevation view in cross section showing an internal structure of the MFD.

As shown in FIGS. 1 and 2, the MFD 10 includes a printer portion 11 and a scanner portion 12 that are integral with each other, and has a printer function, a scanner function, a copier function and a facsimile-machine function. In the present embodiment, the printer portion 11 corresponds to the image recording apparatus to which the present invention is applied. The functions other than the printer function may be omitted, for example, the scanner portion 12 may be omitted. Thus, the present invention may be applied to a single-function printer that has only the printer function and does not have the scanner, copier or facsimile-machine function.

In the MFD 10, the printer portion 11 is provided in a lower portion thereof, and the scanner portion 12 is provided in an upper portion thereof. The MFD 10 is mainly connected to an external data-processor device such as a computer, so that the printer portion 11 can record, based on print data (record data) including image data and/or document data supplied from the computer, images and/or letters (characters) on a recording sheet as a recording medium. The scanner portion 12 is a so-called "flat-bed" scanner.

As shown in FIG. 1, a width (a dimension measured in a direction indicated by an arrow 101) and a length (a dimension measured in a direction indicated by an arrow 103) of the MFD 10 are greater than a height (a dimension measured in a direction indicated by an arrow 102) thereof. Thus, the MFD 10 has a generally rectangular parallelepiped shape. The printer portion 11 includes an opening 13 formed in a front surface of the MFD 10. Inside of the front surface in which the opening 13 is formed, a sheet-supply tray 20 and a sheet-discharge tray 21 are provided. A sheet-feed tray 20 and a sheet-discharge tray 21 are exposed through the front opening 13. The recording sheets accommodated by the sheet-feed tray 20 are supplied, one by one, to the printer portion 11, so that after a desired image is recorded on each recording sheet, the each sheet is discharged onto the sheet-discharge tray 21. In the following description of each of the components, a portion, an end, or a side of the each component which is located nearer to the front opening 13 will be referred to as a front portion, a front end, or a front side of the each component, and a portion, an end, or a side of the each component which is located opposite to the front opening 13 will be referred to as a rear portion, a rear end, or a rear side of the each component.

An operation panel 14 is provided in a front end portion of a top portion of the MFD 10. The operation panel 14 is for operating the printer portion 11 and the scanner portion 12. The operation panel 14 includes various operation keys that are used by a user or an operator to input various commands to operate the MFD 10 and a display that indicates a state of the MFD 10, an error indication and so on. In the case where the MFD 10 is connected to the above-described computer, the MFD 10 can be operated according to commands supplied from the computer via communication software such as a printer driver or a scanner driver.

As shown in FIG. 2, the sheet-feed tray 20 is disposed in a bottom, portion of the MFD 10. The sheet-discharge tray 21 is disposed above the sheet-feed tray 20. In other words, the sheet-feed tray 20 and the sheet-discharge tray 21 have a vertically stacked structure. The sheet-feed tray 20 and the sheet-discharge tray 21 are connected to each other through a sheet-feed path 23 such that the recording sheets can be fed from the sheet-feed tray 20 to the sheet-discharge tray 21. The recording sheets that are accommodated by the sheet-feed tray 20 are fed to an image recording unit 24, guided by a U-turn portion of the sheet-feed path 23 through which the direction of feeding of each recording sheet is changed from a rearward direction to a frontward direction before the each recording sheet is fed to the image recording unit 24. After the image recording unit 24 records the image on the each recording sheet, the each sheet is discharged onto the sheet-discharge tray 21.

The sheet-feed tray 20 has a dish-like shape which includes a plurality of (four in the present embodiment) side walls standing upright from a periphery of a tray surface. The tray surface has an area in which the recording sheets are stacked on each other. The sheet-feed tray 20 can accommodate the plurality of recording sheets that are of a size, for example, not larger than A3 size (defined by JIS), A4 size, B5 size, and Postcard size.

The sheet-discharge tray 21 has a tray-like shape, and the each recording sheet on which an image is recorded is discharged onto an upper surface of the sheet-discharge tray 21. The sheet-discharge tray 21 is located on the front side of the sheet-feed tray 20 in a lengthwise direction of the MFD 10 (the direction indicated by the arrow 103). Therefore, the sheet-discharge tray 21 is not disposed above the sheet-feed tray 20 in the rear side of the MFD 10.

The sheet-supply roller 25 is provided in the rear side of the MFD 10. The sheet-supply roller 25 supplies each recording sheet stacked in the sheet-feed tray 20 to the sheet-feed path 23. A drive force or a rotation force of an LF (Line Feed) motor 77 (shown in FIG. 4) is transmitted to the sheet-supply roller 25 such that the sheet-supply roller 25 is rotated about a rotation axis. The sheet-supply roller 25 is rotatably supported by a lower or distal end portion of a sheet-feed arm 26. The sheet-feed arm 26 is pivotable about a rotation axis such that the distal end portion thereof where the sheet-supply roller 25 is supported functions as a distal end of a pivot, so that the sheet-supply roller 25 is movable upward and downward or movable away from and toward the sheet-feed tray 20. The sheet-feed arm 26 is pivoted downward because of a weight thereof or a biasing force of a spring and is pivoted upward depending on an amount of the recording sheets stacked in the sheet-feed tray 20. Therefore, the sheet-supply roller 25 is in contact with an uppermost one of the recording sheets in the sheet-feed tray 20. When the sheet-supply roller 25 is rotated in this state, due to a friction force between a roller surface of the sheet-supply roller 25 and the uppermost recording sheet, the uppermost recording sheet is fed to the sheet-feed path 23.

The sheet-feed path 23 first extends upward from a rear portion of the MFD 10, and then curves toward the front side of the MFD 10. That is, the sheet-feed path 23 extends from the rear side of the MFD 10 toward the front side thereof via the image recording unit 24, and further extends to the sheet-discharge tray 21. Except for a portion of the sheet-feed path 23 where the image recording unit 24 is provided, the sheet-feed path 23 is defined and constituted by an outer guide surface and an inner guide surface that are opposed to each other with an appropriate distance therebetween. For example, at the U-turn portion of the sheet-feed path 23 in the rear side of the MFD 10, the sheet-feed path 23 is constituted by an outer guide member 18 and an inner guide member 19 which are fixed to each other inside a frame of the MFD 10.

Figure 3:
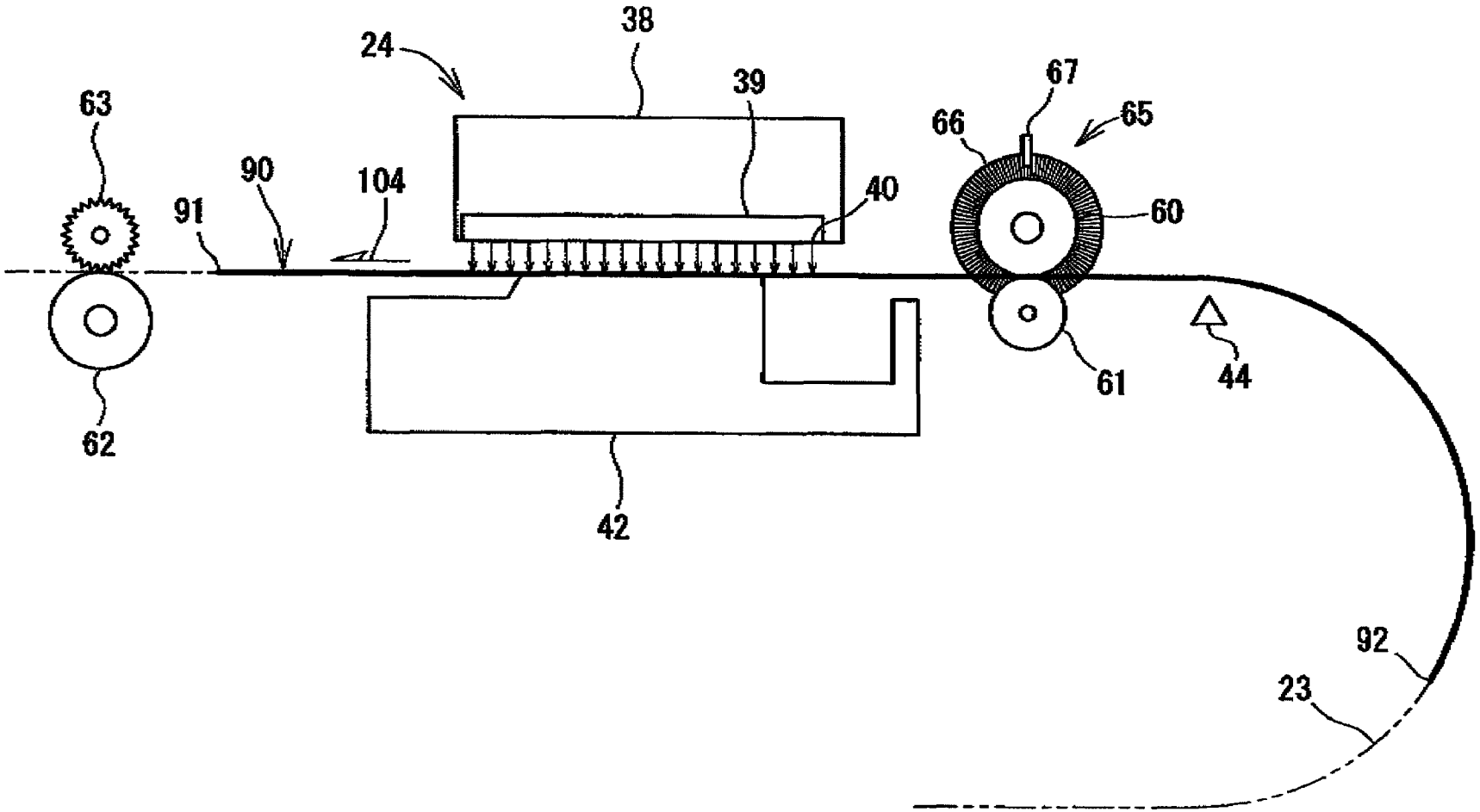
FIG. 3 is a schematic view of an image recording unit and around the image recording unit of the MFD.

As shown in FIGS. 2 and 3, the image recording unit 24 includes a recording head (a printhead) 39 and a carriage 38 that are opposed to each other and spaced from each other at a predetermined distance. A detailed construction of the image recording unit 24 will be described later.

A feed roller (a convey roller) 60 and a pinch roller 61 are provided on an upstream side of the image recording portion 24 in a feed direction 104 in which each recording sheet is fed from the tray 20. Although the pinch roller 61 is not shown in FIG. 2 behind other members, the pinch roller 61 is disposed below the feed roller 60, as shown in FIG. 3. The pinch roller 61 is movable toward and away from the feed roller 60 and is held in pressed contact with the feed roller 60 by a biasing force of an elastic member such as a spring. The feed roller 60 is driven or rotated by the LF motor 77.

As shown in FIG. 3, a rotary encoder 65 is provided in association with the feed roller 60. The rotary encoder 65 includes an encoder disc 66 which is disposed rotatably about the same rotation axis as the feed roller 60 and rotates with the feed roller 60, and an optical sensor 67 of transmission type. The encoder disc 66 includes transparent portions as sensible portions and shielding portions as non-sensible portions alternately arranged at a predetermined pitch in a circumferential direction thereof. Not precisely shown in FIG. 3, the optical sensor 67 has a light-emitting element which emits a light toward the encoder disc 66, and a light-receiving element which is opposed to the light-emitting element through the encoder disc 66 and receives a light emitted from the light-emitting element. When the encoder disc 66 rotates with the feed roller 60, a light emitted from the light-emitting element is intercepted by the shielding portions of the encoder disc 66 at the predetermined pitch. The light-receiving element produces electric pulse signals corresponding to strength of a received light. A rotation amount of the feed roller 60 is calculated based on the pulse signals.

The recording sheet 90 is fed in the feed direction 104 by a rotation of the feed roller 60 in a state in which the feed roller 60 and the pinch roller 61 cooperate with each other to nip the recording sheet 90. At this time, the pinch roller 61 is rotated with feeding of the recording sheet 90.

A sheet discharge roller 62 and a spur roller 63 are provided on a downstream side of the image recording portion 24 in the feed direction. Though the spur roller 63 is not shown in FIG. 2 behind other members, as shown in FIG. 3, the spur roller 63 is disposed above the sheet discharge roller 62. The spur roller is movable toward and away from the sheet-discharge roller 62 and is held in pressed contact with the sheet-discharge roller 62 by a biasing force of an elastic member such as a spring. The sheet-discharge roller 62 is driven and rotated by the LF motor 77. The sheet-discharge roller 62 and the feed roller 60 are rotated in synchronism with each other. The sheet-discharge roller 62 and the spur roller 63 cooperate with each other to nip the recorded (printed) recording sheet 90 and to feed the same 90 onto the sheet-discharge tray 21.

When an image recording is performed, the feed roller 60 and the sheet-discharge roller 62 are intermittently driven or rotated. In other words, each of the feed roller 60 and the sheet-discharge roller 62 is successively rotated by a rotation amount corresponding to a target feed amount, and when each rotation amount reaches the target feed amount, a rotation of each of the feed roller 60 and the sheet-discharge roller 62 is stopped for a predetermined time. The target feed amount varies depending on a resolution of an image which should be recorded on the recording sheet. For example, in a case where the image recording of interlace type is performed, the target feed amount in the image recording in a fine mode with a high resolution is generally determined to be smaller than the target feed amount in the image recording in a normal mode with a resolution of a middle extent.

When the image recording is not performed, it is not necessary that the feed roller 60 and the sheet-discharge roller 62 are intermittently driven. Therefore, when the recording sheet is fed before a performance of the image recording, and when the recording sheet is discharged after the performance of the image recording, the feed roller 60 and the sheet-discharge roller 62 may be successively rotated.

A feeding device in the present invention consists of the feed roller 60, the pinch roller 61, the sheet-discharge roller 62 and the spur roller 63.

As shown in FIG. 3, on an upstream side of the feed roller 60 in the sheet-feed path 23 in the feed direction, a resistor sensor 44 is located. The resistor sensor 44 detects an existence of the recording sheet 90 passing through the sheet-feed path 23. Not shown in detail in FIG. 3, the resistor sensor 44 is a mechanical sensor in which an optical sensor detects a movement of a sensing element that is provided so as to rise and set in the sheet-feed path 23. The sensing element of the resistor sensor 44 protrudes to the sheet-feed path 23 in a state in which the recording sheet 90 is not in contact with the sensing element, and is retracted from the sheet-feed path 23 when the recording sheet 90 is put into contact with the sensing element. This rising and setting of the sensing element is detected by the optical sensor such that ON/OFF electric signals are generated. Thus, when the recording sheet 90 does not exist in a position where the resistor sensor 44 is provided, an OFF signal is outputted from the resistor sensor 44, while, when the recording sheet 90 exists therein, an ON signal is outputted from the resistor sensor 44. Based on a change or a shift of the thus outputted signals from the resistor sensor 44, it is determined whether a top end or a leading end 91 (located on a downstream side of the recording sheet in the feed direction) or a bottom end or a trailing end 92 (located on an upstream side of the recording sheet in the feed direction) of the recording sheet 90 reaches the position where the resistor sensor 44 is provided.

As shown in FIG. 3, the image recording unit 24 mainly consists of the carriage 38, the recording head 39 and a platen 42. The recording head 39 corresponds to a recording device in the present invention.

As shown in FIG. 3, between the feed roller 60 and the pinch roller 61 as a pair, and the sheet-discharge roller 62 and the spur roller 63 as another pair, there are provided the carriage 38 above the sheet-feed path 23 and the platen 42 below the same 23. The carriage 38 carries the recording head 39 of an inkjet type. The carriage 38, driven by a carriage (CR) motor 79 (shown in FIG. 4), reciprocates in the main scanning direction, or in a horizontal direction perpendicular to the feed direction 104 (in a direction perpendicular to a sheet plane of FIG. 3) above the sheet-feed path 23. Not shown in FIG. 3, there are a plurality (four in the present embodiment) ink cartridges disposed in the MFD 10, independently of the recording head 39. The four ink cartridges store a cyan ink (C), a magenta ink (M), a yellow ink (Y), and a black ink (K), respectively, and supply those inks to the recording head 39 via respective ink-supply tubes.

Below the sheet-feed path 23, the platen 42 is disposed so as to be opposed to the recording head 39. The platen 42 extends over an intermediate portion of a range of reciprocating movement of the carriage 38, i.e., a portion of the range where the recording sheets 90 pass. A width of the platen 42 as measured in a widthwise direction of the sheet-feed path 23 is larger than a maximum width of all sorts of the recording sheets that can be used in the printer portion 11. A constant (fixed) distance is maintained between the recording head 39 and the recording sheets 90 that are supported by an upper surface of the platen 42.

As mentioned previously, the carriage 38 reciprocates while the feed roller 60 and the sheet-discharge roller 62 are stopped. During a reciprocating movement of the carriage 38, the recording head 39 selectively ejects tiny droplets of inks of the respective colors through a plurality of nozzles thereof toward each recording sheet 90. The ink droplets ejected from the nozzles of the recording head 39 are landed on or received by each recording sheet 90 being temporarily stopped on the platen 42.

Hereinafter, a construction of a control portion (a controller) 70 of the MFD 10 will be described. The control portion 70 corresponds to a control device in the present invention. The control portion 70 is for controlling various operations of the MFD 10 including not only the printer portion 11 but also the scanner portion 12. Since the scanner portion 12 is not a major component to which the present invention is applied, detailed description thereof is omitted.

Figure 4:
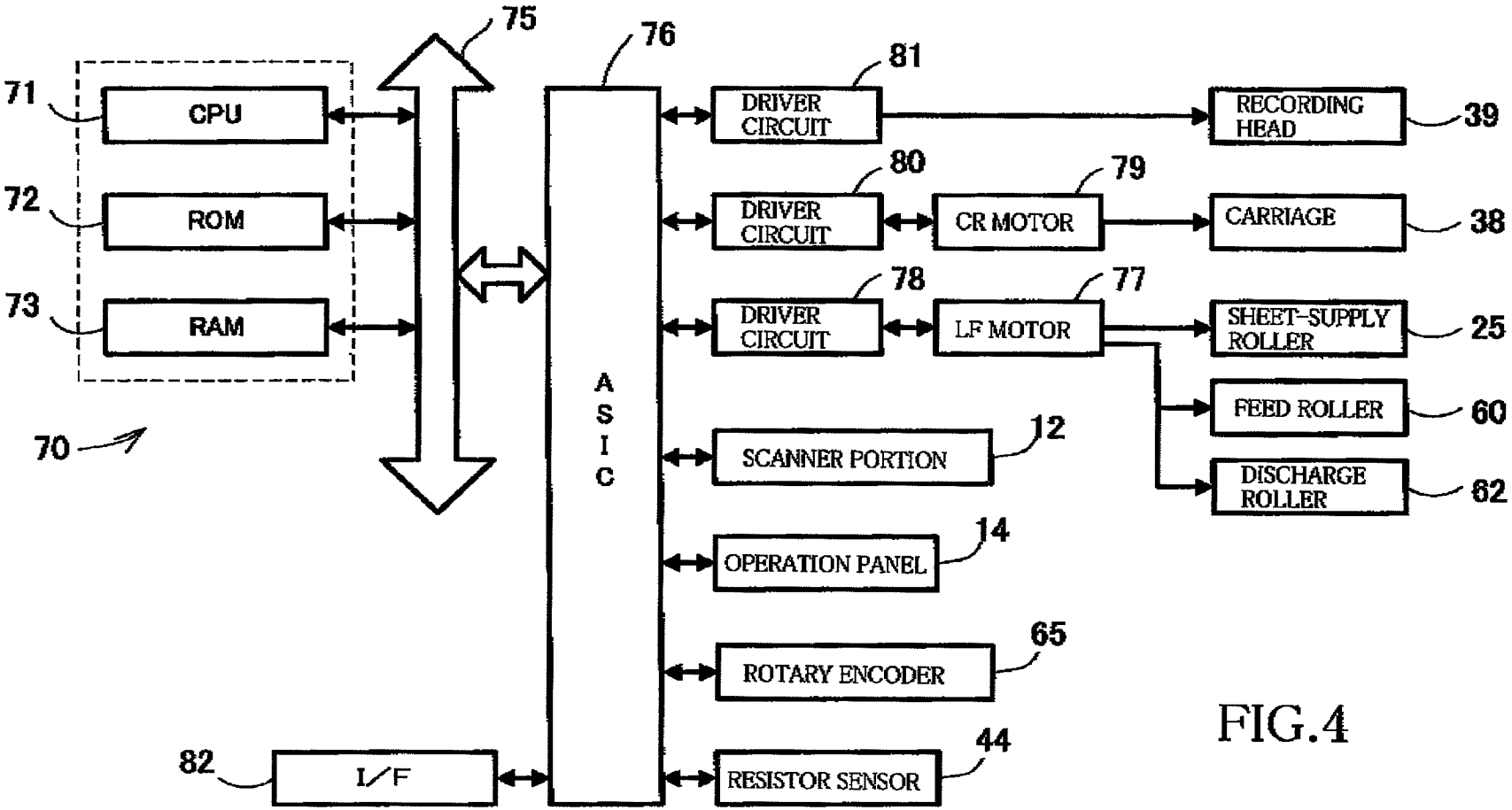
FIG. 4 is a block diagram showing a structure of a control portion of the MFD.

As shown in FIG. 4, the control portion 70 mainly includes a CPU (Central Processing Unit) 71, a ROM (Read Only Memory) 72 and a RAM (Random Access Memory) 73. The control portion 70 is connected to the sensors, the scanner portion 12, and the operation panel 14 and so forth such that data can be transmitted and received therebetween through a bus line 75 and an ASIC (Application Specific Integrated Circuit) 76. The RAM 73 functions as a kind-information retaining portion in the present invention. The operation panel 14 also functions as a kind-information receiving portion in the present invention.

In the ROM 72, various programs for controlling various operations of the MFD 10 are stored. By implementing one of the programs, the control portion 70 functions as a feed-amount correcting portion and a recording-position adjusting portion in the present invention. In other words, by the control portion 70, a correction rate C of a target feed amount F1 is determined corresponding to a kind of the recording sheet 90, and corresponding to a correction of the target feed amount F1, a record-initiating position 93 (shown in FIG. 6) where the image recording is initiated on the recording sheet 90 is adjusted. The record-initiating position 93 corresponds to a first position in the present invention.

The RAM 73 is used as a memory area or an operation area in which various data that are used when the CPU 71 implements the programs are temporarily stored.

The ASIC 76 generates a PWM (Pulse Width Modulation) signal fed to the LF motor 77 according to a command from the CPU 71 and feeds the PWM signal to a driver circuit 78. Because a PWM current corresponding to a drive signal is supplied from the driver circuit 78 to the LF motor 77, the control portion 70 controls a rotation of the LF motor 77.

The driver circuit 78 is arranged to drive the LF motor 77 that is connected to the sheet-supply roller 25, the feed roller 60 and the sheet-discharge roller 62. The driver circuit 78 generates the PWM current for the rotation of the LF motor 77 when an output signal from the ASIC 76 is received. The LF motor 77 is rotated when the PWM current is received, and a rotation force of the LF motor 77 is transmitted to the sheet-supply roller 25, the feed roller 60 and the sheet-discharge roller 62 via a well-known drive transmission device including a gear and a drive shaft.

The ASIC 76 generates a PWM signal fed to the CR motor 79 according to a command from the CPU 71 and feeds the PWM signal to a driver circuit 80 of the CR motor 79. The driver circuit 80 is for driving the CR motor 79 that is connected to the carriage 38. The driver circuit 80 receives the output signal and generates a PWM current for a rotation of the CR motor 79. The CR motor 79 is rotated by receiving the PWM current. The carriage 38 is reciprocated when a rotation force of the CR motor 79 is transmitted to the carriage 38 via a carriage drive device or a belt drive device.

The driver circuit 81 is for selectively ejecting the respective colors of inks from the recording head 39 toward the recording sheet 90 at a predetermined timing. The ASIC 76 generates an output signal based on a drive control signal outputted from the CPU 71. The driver circuit 81 receives the output signal from the ASIC 76 and drives and controls the recording head 39.

The resistor sensor 44 is connected to the ASIC 76. A sensing signal from the resistor sensor 44 is stored in the RAM 63 via the ASIC 76 and the bus line 75. Based on a program stored in the ROM 62, the CPU 71 analyzes the sensing signal and determines respective positions of the top end 91, and the bottom end 92 of the recording sheet 90 in the sheet-feed path 23. The CPU 71 determines the respective positions of the top end 91 and the bottom end 92 of the recording sheet 90 in the sheet-feed path 23, based on respective timings at which the top end 91 and the bottom end 92 thereof are detected and respective feed amounts of the feed roller 60.

Further, the operation panel 14 is connected to the ASIC 76. An operation command of the printer portion 11, a kind and a size of the recording sheet 90, a resolution of a recorded image, margins provided in the recording sheet 90 and a command of a borderless printing that are inputted by the user or the operator from the operation panel 14 are stored in the RAM 73 as kind information and various configuration information thorough the ASIC 76 and the bus line 75.

Furthermore, the interface (I/F) 82 is connected to the ASIC 76. The control portion 70 can transmit data to the external data-processor device and receive data from the external data-processor device through the interface 82. The external data-processor device is, for example, the computer in which the printer driver is installed. The kind of the recording sheet 90 that is inputted when the printer portion 11 is operated may be inputted from the operation panel 14 or from the printer driver of the external data-processor device. In the latter case, it can be considered that the external data-processor device functions as the kind-information receiving portion in the present invention and a RAM of the external data-processor device functions as the kind-information retaining portion in the present invention. It can also be considered that the I/F 82 functions as the kind-information receiving portion. Further, in a case where the kind information received by the I/F 82 is stored in the RAM 73, it can be considered that the RAM 73 functions as the kind-information retaining portion.

Figure 5:
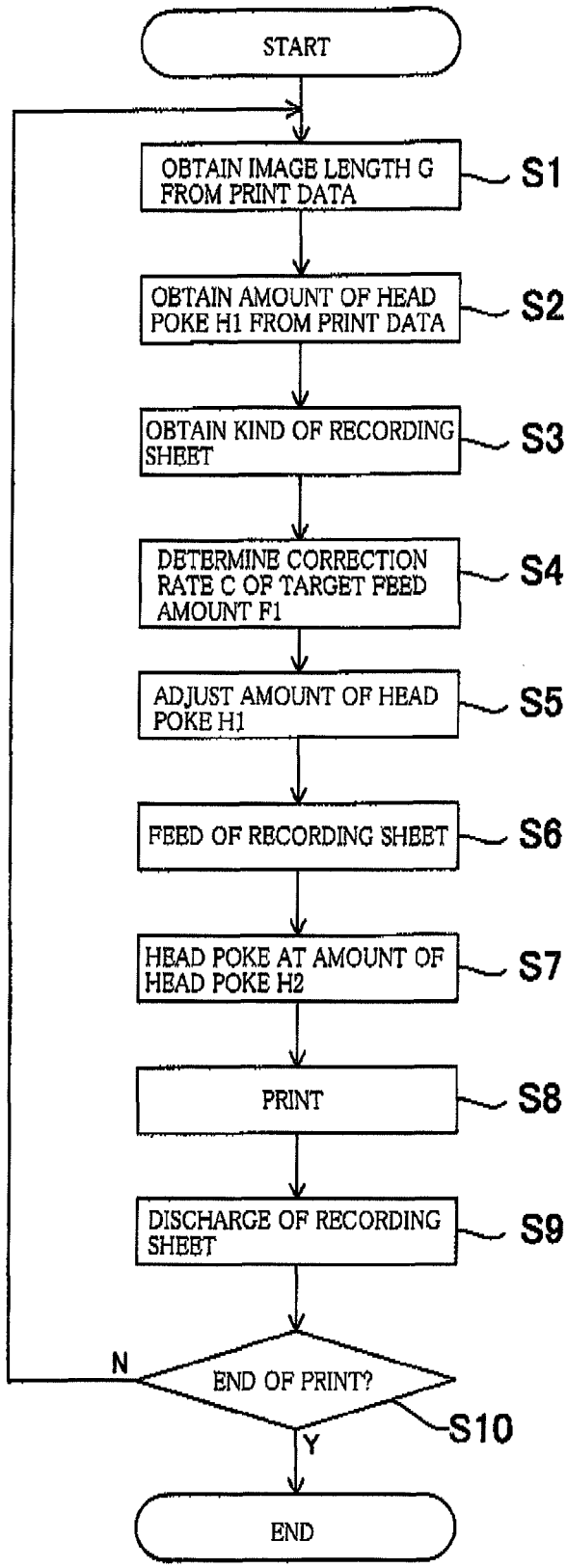
FIG. 5 is a flow chart illustrating a image recording method by a printer portion.

Hereinafter, a method of adjusting an amount of head poke H1 in the printer portion 11 will be described by reference to a flow chart of FIG. 5 illustrating a program for a printing operation by the printer portion 11. Prior to an input of the command to initiate a printing operation, from the operation panel 14, a kind and a size of the recording sheet 90, a resolution of a recorded image, and margins provided in the recording sheet 90 are inputted by the operator. The MFD 10 operates to store the kind and the size of the recording sheet 90, the resolution of the recorded image, the margins provided in the recording sheet 90 and the command of the borderless printing, respectively as the configuration information including the kind information in the RAM 73.

The kind of the recording sheet 90 includes, for example, in a case where the recording sheet 90 is made of paper, a kind of paper and an existence of coating thereon, and a difference between a machine-direction oriented sheet and a cross-direction oriented sheet in a case where the recording sheets 90 are made of a material of the same kind. In the present embodiment, a sheet in which a grain direction is a longitudinal (lengthwise) direction or a machine direction of the recording sheet 90 as a cut sheet is referred to as "the machine-direction oriented sheet", and a sheet in which the grain direction is a cross direction of the cut sheet along a short side thereof is referred to as "the cross-direction oriented sheet". The kind of the recording sheet 90 is indicated on the operation display 14 in the form of a plurality of kinds so as to be selected, and either one of the kinds is selected depending on the recording sheets 90 that are accommodated by the sheet-feed tray 20.

The size of the recording sheet 90 includes, e.g., A3 size, A4 size and B5 size, defined by JIS (Japanese Industrial Standards). The recording sheets 90 of the above-mentioned sizes are so-called cut sheets, and each of the recording sheets 90 has a predetermined sheet length L in the feed direction 104. For example, in a case where the recording sheet 90 of A3 size is fed in a longitudinal direction thereof, the sheet length L is 420 mm. The sheet length L corresponds to a first length in the present invention.

The resolution of the recorded image on the recording sheet 90 includes, e.g., 600 dpi, 1200 dpi and 2400 dpi. The margins can be provided on the top end 91 of the recording sheet 90, the bottom end 92 thereof and opposite sides thereof. In the present embodiment, the margin on a side of the top end 91 thereof is referred to as a margin M1, and the margin on a side of the bottom end 92 thereof is referred to as a margin M2. The margins M1, M2 are indicated at a unit of millimeter. In a case where the borderless printing is selected, the margins M1, M2 cannot be set, so that the protrusion amounts or negative amounts of margins on the top end 91 and the bottom end 92 of the recording sheet 90 are determined.

When the command to initiate the printing operation is inputted, the control portion 70 obtains the print data. The print data are data, e.g., based on image data that are scanned in the scanner portion 12 in a case where the copier function is operated in the MFD 10, or, in a case where the printing operation is performed based on image data that are formed by using of an application in the external data-processor device, the print data are transmitted to the MFD 10 via the printer driver.

The control portion 70 that receives the print data obtains an image length G in the feed direction in the image data that are included in the print data (step S1 in FIG. 5). For example, in a case where the recording sheet 90 of A3 size is fed in the longitudinal direction thereof and the margins M1, M2 each of which is 10 mm are provided respectively on the top end 91 and the bottom end 92 of the recording sheet 90, the image length G is 400 mm. The image length G corresponds to a second length in the present invention.

Figure 6:
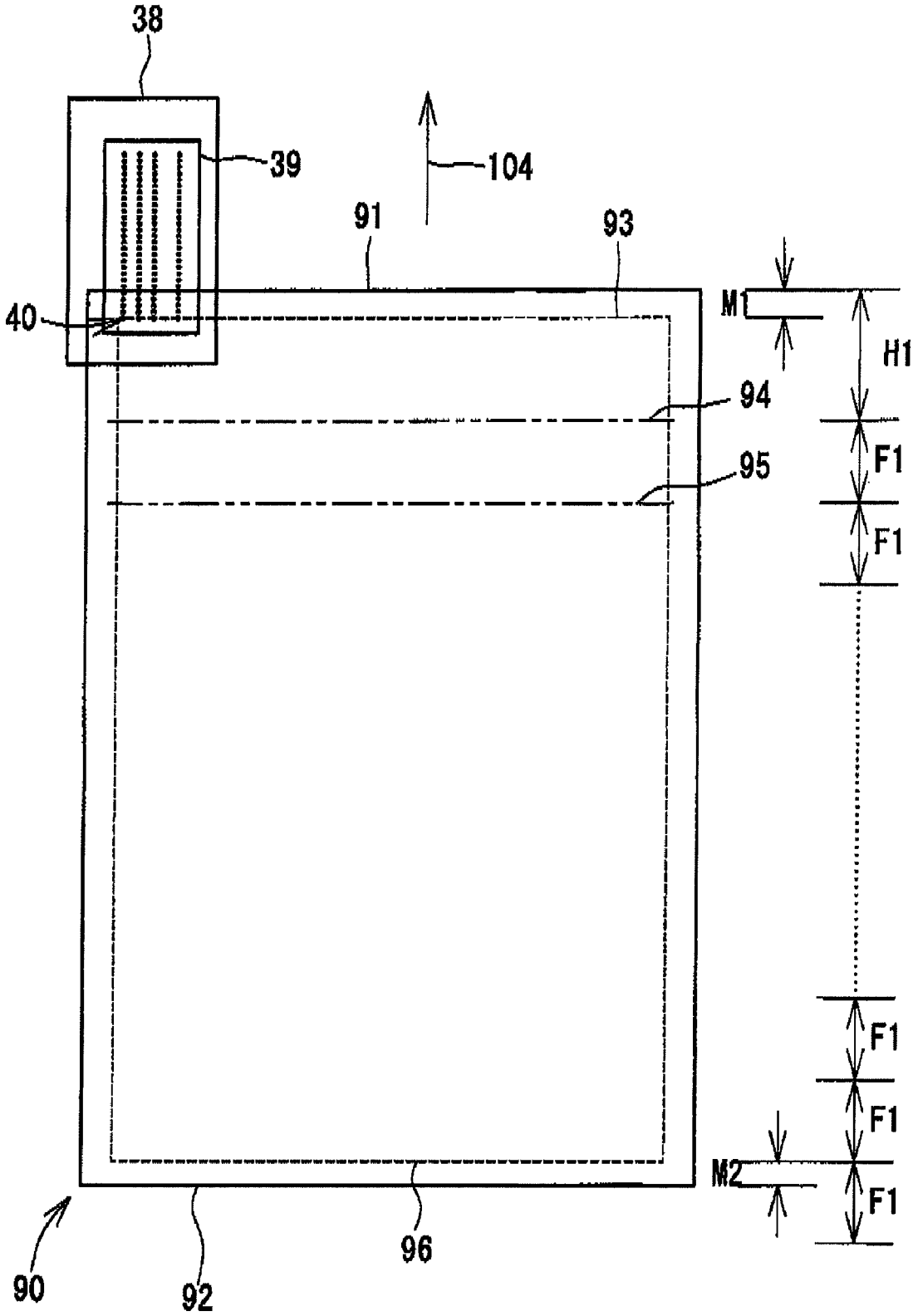
FIG. 6 is a schematic view showing relations among an amount of head poke H1, respective margins M1, M2 and a target feed amount F1 of a recording sheet.
Figure 7:
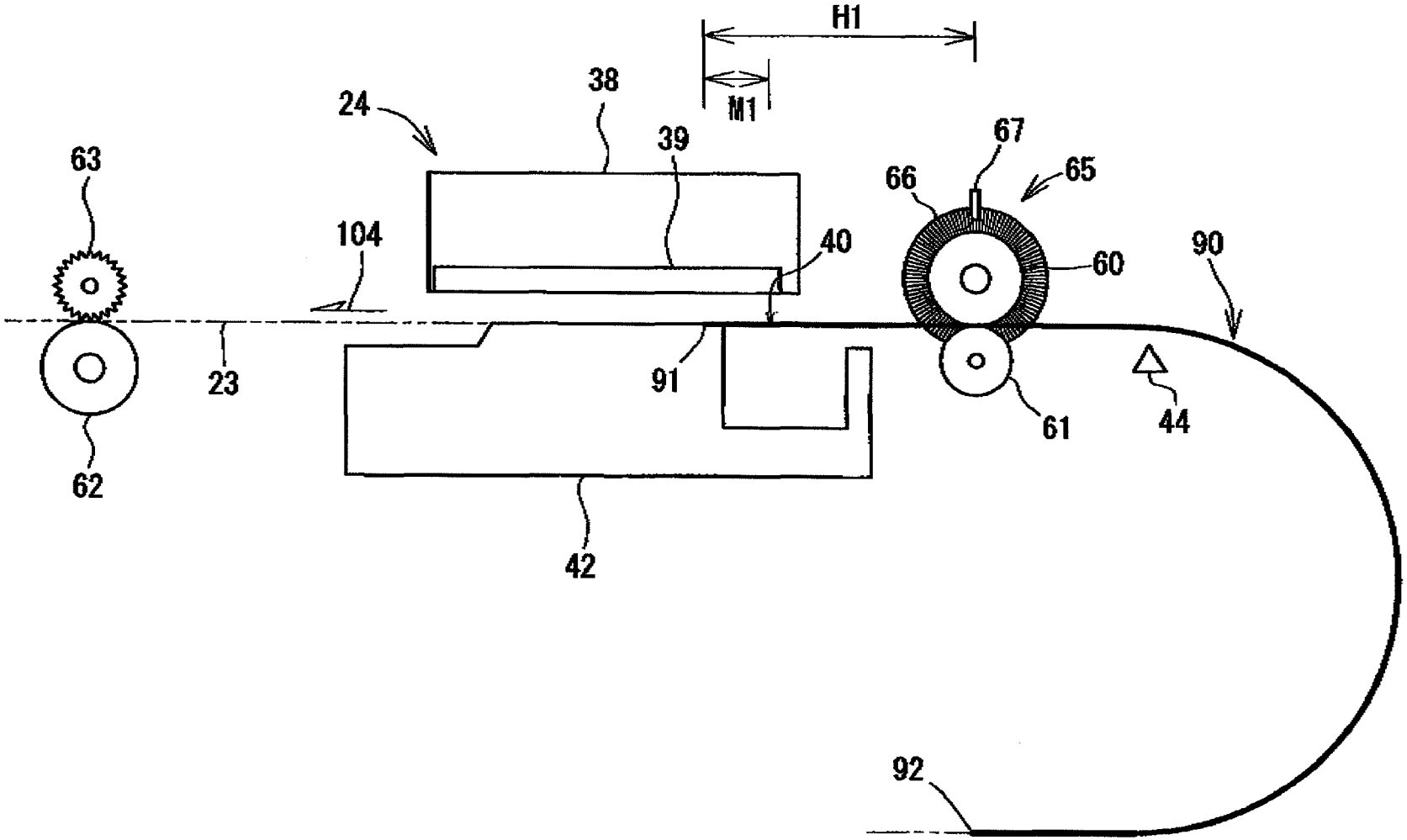
FIG. 7 is a schematic view of a state of the recording sheet after a head poke is performed in the printer portion.

Next, in step S2, the control portion 70 obtains the amount of head poke H1 included in the print data. As shown in FIGS. 6, 7, the amount of head poke H1 is a target amount for feeding the top end 91 of the recording sheet 90 to the downstream side in the feed direction 104 from a nip position where the feed roller 60 and the pinch roller 61 nip the recording sheet 90, when the image recording on the side of the top end 91 of the recording sheet 90 is initiated. In the recording sheet 90 that is fed by the amount of head poke H1, the record-initiating position 93, i.e., a position spaced from the top end 91 of the recording sheet 90 to the bottom end 92 thereof by the margin M1, corresponds to or is opposed to a first nozzle 40 or a first one of the nozzles of the recording head 39 that is located on a most upstream side in the feed direction 104, and a first nip position 94 of the recording sheet 90 is nipped by the feed roller 60 and the pinch roller 61 in order that the recording sheet 90 is stopped. The above-mentioned state is a state of completion of a head poke, and, in the present embodiment, a first recoding operation is initiated at a position where the recording sheet 90 is fed by the target feed amount F1 further from the state of completion of the head poke. However, it is not necessary that the recording sheet 90 is stopped in the state of completion of head poke. The recording sheet 90 may be first stopped after being fed by an amount equal to a total amount of the head poke H1 and the target feed amount F1, and the first recording operation may be performed in this state. The amount of head poke H1 may be corrected based on a characteristic value corresponding to variations such as a dimension error of each of a plurality of MFDs 10.

Then, in step S3, the control portion 70 obtains the kind of the recording sheet 90 based on the kind information stored in the RAM 73. For example, in a case where the cross-direction oriented sheet is selected from the operation panel 14, the kind of the recording sheet 90 is the cross-direction oriented sheet. The control portion 70 determines, in step S4, the correction rate C of the target feed amount F1 depending on the kind of the recording sheet 90 that is received by the control portion 70. An amount of extension or contraction of the recording sheet 90 due to ink permeation varies depending on the kind of the recording sheet 90. Therefore, in a case where the recording sheet 90 is a sheet of a kind whose amount of extension or contraction is relatively large, the correction rate C is determined to be larger, while, in a case where the recording sheet 90 is a sheet of a kind whose amount of extension or contraction is relatively small, the correction rate C is determined to be smaller. Further, in a case where the recording sheet 90 is a sheet of a kind that extends due to ink permeation, the correction rate C is determined to be positive, while, in a case where the recording sheet 90 is a sheet of a kind that contracts or shrinks due to ink permeation, the correction rate C is determined to be negative. The correction rate C is determined depending on the kind of the recording sheet 90, based on, e.g., a look-up table as shown in Table 1. The look-up table is previously stored in the ROM 71. In Table 1, Kinds A, B, C, D and E are, e.g., the machine-direction oriented sheet, the cross-direction oriented sheet, a glossy sheet, and so on. For example, in a case where Kind A is the cross-direction oriented sheet, the correction rate C is determined as +1.0%.

TABLE 1

| Kind of Recording Sheet | Correction Rate C |
|---|---|
| A | +1.0% |
| B | +0.5% |
| C | 0 |
| D | −0.5% |
| E | −1.0% |

In step S5, the correction amount of head poke H is determined based on the correction rate C of the target feed amount F1. More precisely, in a case where the correction rate C is 0, the target feed amount F1 is determined based on the resolution of the recorded image on the recording sheet 90, and the image length G of the image recorded on the recording sheet 90 that is fed by the target feed amount F1 is in accordance with a value (the image length G or the second length) that is obtained from the print data, as shown in FIG. 8A. On the other hand, in a ease where the correction rate C is determined as a value except 0, the target feed amount F1 is corrected to be increased or decreased, so that the image length G of the image recorded on the recording sheet 90 is extended or contracted, as shown in FIG. 5B. The amount of extension or contraction is a difference between the image length G (the second length) of the image that is assumed to be recorded on the recording sheet 90 in a case where the recording sheet 90 is fed by a feed amount in accordance with the target feed amount F1 and the image length G (a third length) of the image that is assumed to be recorded on the recording sheet 90 in a case where the recording sheet 90 is fed by a target feed amount F2 that is a corrected feed amount. The difference between the second length and the third length is expressed by the image length G×the correction rate C or multiplying the image length G and the correction rate C together (hereinafter, referred to as "the difference GC"). When the difference is positive, the image is extended, on the other hand, when the difference is negative, the image is contracted. In other words, the image length of the image recorded on the recording sheet 90 corresponding to a correction of the target feed amount F1 is expressed by the image length (G+GC). The image length (G+GC) corresponds to the third length in the present invention.

In step S5, the control portion 70 adjusts the amount of head poke H1 based on the correction rate C of the target feed amount F1, as described above. In a case where the target feed amount F1 is corrected to be increased based on the correction rate C and the recording sheet 90 is fed by the increased target feed amount F2, the image length G of the image recorded on the recording sheet 90 is extended in the feed direction 104 by the difference GC. The control portion 70 adjusts the amount of head poke H1 in order that the margin M1 on the top end 91 of the recording sheet 90 decreases by a half of the difference GC. An adjustment of the amount of head poke H1 is expressed by such an expression as follows:

a corrected amount of head poke $H2$=the amount of head poke $H1-\frac{1}{2}\times$the difference $GC$.

Due to the adjustment of the amount of head poke H1, the record-initiating position 93 is adjusted.

After the amount of head poke H1 is adjusted as mentioned above, the printing operation is performed (FIG. 5: steps S6 through S10). More precisely, in step S6, when the sheet-supply roller 25 is rotated by the LF motor 77, one of the recording sheets 90 accommodated by the sheet-feed tray 20 is fed to the sheet-feed path 23. The recording sheet 90 is fed through the sheet-feed path 23 in the feed direction 104, and the top end 91 thereof reaches the resistor sensor 44. When the resistor sensor 44 detects the top end 91 of the recording sheet 90, the output signal from the resistor sensor 44 is shifted from the OFF signal to the ON signal. When a predetermined time has passed (elapsed) since the output signal from the resistor sensor 44 is shifted, the top end 91 of the recording sheet 90 reaches the nip position of the feed roller 60 and the pinch roller 61. Therefore, the control portion 70 determines that the top end 91 of the recording sheet 90 arrives at the nip portion, based on the shift of the output signal from the resistor sensor 44 and a passing time.

When the top end 91 of the recording sheet 90 reaches the nip position, the feed roller 60 is not rotated. Accordingly, the recording sheet 90 is bent because the top end 91 thereof is put into contact with a roller surface of the feed roller 60 or a roller surface of the pinch roller 61. Thus, an inclination of the recording sheet 90 in the sheet-feed path 23 is corrected. Then, the control portion 70 rotates the feed roller 60, so that the feed roller 60 and the pinch roller 61 nip the top end 91 of the recording sheet 90.

The control portion 70 obtains the rotation amount of the feed roller 60 since the rotation thereof is initiated, based on the pulse signals from the rotary encoder 65. The control portion 70 thus determines a position of the top end 91 of the recording sheet 90. In step S7, the control portion 70 rotates the feed roller 60 such that the recording sheet 90 is successively fed by the above-mentioned amount of head poke H2, and then, the feed roller 60 is stopped. Therefore, the recording sheet 90 is stopped in a state in which the record-initiating position 93 of the recording sheet 90 is positioned right below or is opposed to the first nozzle 40 of the recording head 39.

As shown in FIG. 8, because the amount of head poke H1 is adjusted, the margin M1 of the recording sheet 90 becomes a value subtracting the half of the difference GC from the margin M1 that is inputted before the printing operation. In a case where the correction rate C is determined positive, as mentioned before, the image recording is initiated from a position on the side of the top end 91 relative to a position corresponding to the margin M1 that is inputted before the printing operation. In other words, the record-initiating position 93 is moved to the side of the top end 91 of the recording sheet 90 by the half of the difference GC.

When the recording sheet 90 is stopped in a state in which a head poke of the recording sheet 90 is finished, the control portion 70 drives the CR motor 79 such that the droplets of inks are selectively ejected from the recording head 39 based on the print data. The image recording on the recording sheet 90 is thus performed from the adjusted record-initiating position 93 (step S8). Hereinafter, a unit in which the image recording is performed by ejecting the droplets of inks from the recording head 39 during one reciprocating movement of the carriage 38 is referred to as "one pass".

When a first pass of the image recording is finished, after stopping the rotation of the CR motor 79, the control portion 70 drives the LF motor 77 again to rotate the feed roller 60. At this time, the rotation amount of the feed roller 60 is the target feed amount F2 that is corrected based on the correction rate C. More precisely, the target feed amount F1 is determined depending on the resolution of a desired image, as mentioned before. In a case where the image is recorded on the recording sheet 90 by a constant target feed amount F1, the target feed amount F1 is expressed by the following expression:

$F1$=a length of the recording head 39×a nozzle resolution of the recording head 39/the resolution of the desired image In a case where the recording sheet 90 is neither extended nor contracted, when the image recording of interlace type is performed by the above-mentioned target feed amount F1, rows of dots ink droplets) that are spaced from each other by the identical pitch are formed on the recording sheet 90. The target feed amount F1 may be corrected based on a characteristic value corresponding to variations such as error of each of the plurality of MFDs 10.

As mentioned before, the target feed amount F2 is obtained by that the target feed amount F1 is multiplied by the correction rate C depending on the kind of the recording sheet 90. Since the target feed amount F1 is corrected in such a manner as described above, it is expected that a banding caused by the extension or contraction of the recording sheet 90 is reduced.

Whether the rotation amount of the feed roller 60 reaches the corrected target feed amount F2 or not is determined based on the pulse signals from the rotary encoder 65. The control portion 70 controls the feed roller 60 and the pinch roller 61 to feed the recording sheet 90 by the target feed amount F2 and then, to stop the same 90. Accordingly, after the recording sheet 90 is fed by the target feed amount F2 in the feed direction 104, the recording sheet 90 is stopped. At this time, the feed roller 60 and the pinch roller 61 nip the recording sheet 90 at a second nip position 95 thereof. Though, in FIG. 6, the second nip portion 95 is shown based on the amount of head poke H1 and the target feed amount F1, in this embodiment, the amount of head poke H1 and the target feed amount F1 are respectively corrected to be the amount of head poke H2 and the target feed amount F2, so that the second nip position 95 is moved corresponding to those corrected amounts H2, F2.

When feeding of the recording sheet 90 is stopped, the control portion 70 drives the CR motor 79 and the ink droplets are selectively ejected from the recording head 39 based on the print data. A second pass of the image recording is thus performed. When the second pass of the image recording is finished, after stopping the CR motor 79, the control portion 70 drives the LF motor 77 again to rotate the feed roller 60, so that the recording sheet 90 is fed in the feed direction 104 by the target feed amount F2 that is corrected based on the correction rate C, and then the feed roller 60 is stopped. Similar to the description before, because a third pass of the image recording is performed. Because an intermittent feeding by the target feed amount F2 and one pass of the image recording is alternately performed, the image is recorded in order from the top end 91 of the recording sheet 90 to the bottom end 92 thereof till a record-ending position 96. In the print data, in order that the image is recorded on the recording sheet 90 with the margin M2 provided on a side of the bottom end 92 of the recording sheet 90, the image data are formed so as to have a length G that is expressed by the following expression:

$$G=L-M1-M2$$

When the bottom end 92 of the recording sheet 90 passes through the nip position where the feed roller 60 and the pinch roller 61 nip the recording sheet 90, the recording sheet 90 is nipped by the sheet-discharge roller 62 and the spur roller 68 and is fed in the feed direction 104. At this time, similar to the above description, the intermittent feeding and the one pass of the image recording is alternately performed and the image recording is performed. When the recording sheet 90 reaches the record-ending position 96, the image recording is finished. The record-ending position 96 is a position that is distanced from the bottom end 92 of the recording sheet 90 to the top end thereof by a distance subtracting the half of the difference GC from the margin M2. The recording sheet 90 on which the image is recorded is nipped by the sheet-discharge roller 62 and the spur roller 63 so as to be discharged onto the sheet-discharge tray 21 (step S9).

In a case where the print data includes the print data for a next page or a following recording sheet, i.e., an affirmative decision (Yes) is obtained in step S10, the image length G of the image that is recorded on the next page is obtained in step S1, and then, similar to the above description, the amount of head poke H1 of the following recording sheet 90 is adjusted based on the correction rate C of the target feed amount F1 and the print operation on the next page is performed. On the other hand, in a case where the print data includes no print data on the next page, i.e., a negative decision (No) is obtained in step S10, the printing operation is ended.

Figure 8B:
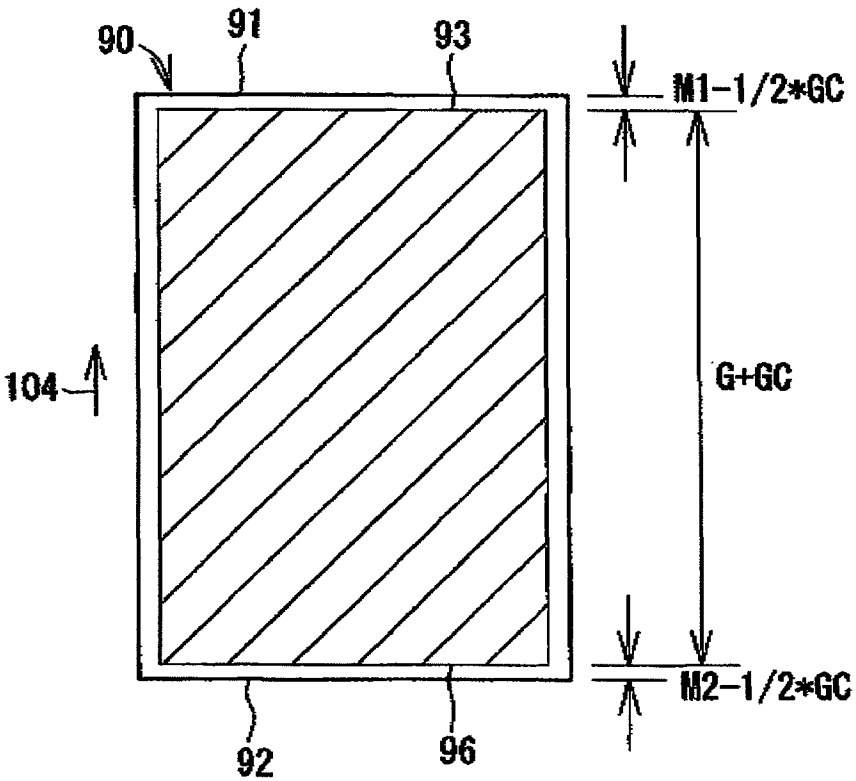
FIG. 8B is a plan view of the recording sheet on which the image is recorded in a case where the correction rate C is positive.
Figure 8A:
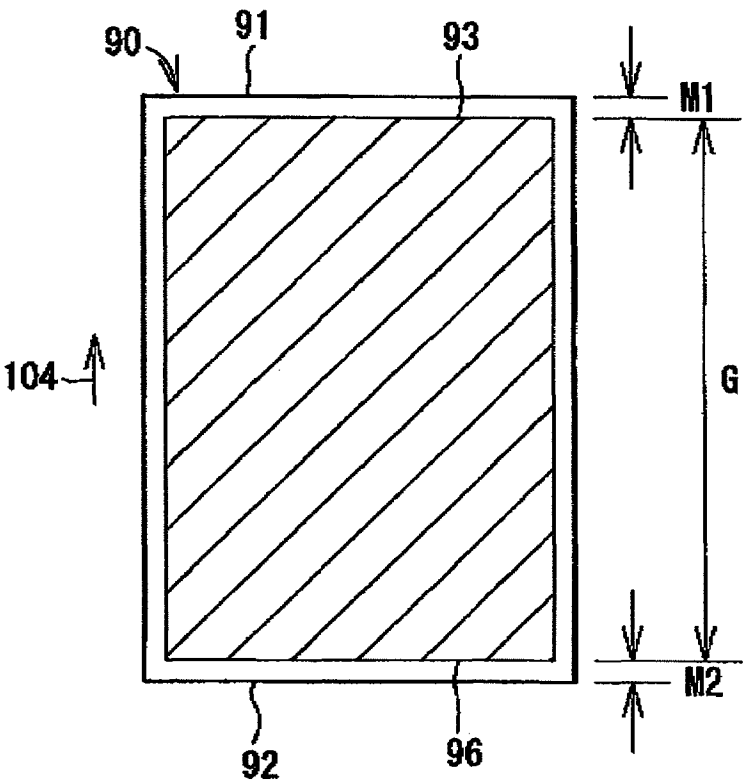
FIG. 8A is a plan view of the recording sheet on which an image is recorded in a case where a correction rate C is 0.

As shown in FIG. 8B, on the recording sheet 90 that is fed by the target feed amount F2 that is corrected based on the positive correction rate C, the image or the image length (G+GC) of the image that extends in the feed direction 104 by the difference GC is recorded. Because the amount of head poke H1 is adjusted on the recording sheet 90, the difference GC extending in the feed direction 104 is absorbed or compensated not only by the margin M2 on the bottom end 92 of the recording sheet 90, but also by the margin M1 on the top end 91 thereof. In other words, the image on the recorded recording sheet 90 is extended to the respective margins M1, M2 equally by the half of the difference GC. Therefore, it is prevented that only the margin M2 on the bottom end 92 is decreased, or that an upstream side or a bottom end portion of the image to be recorded in the feed direction 104 is not recorded on the recording sheet 90.

Although operations in a case where the margins M1, M2 are set on the recording sheet 90 have been described so far, in the borderless printing, the amount of head poke H may be similarly adjusted.

Figure 9:
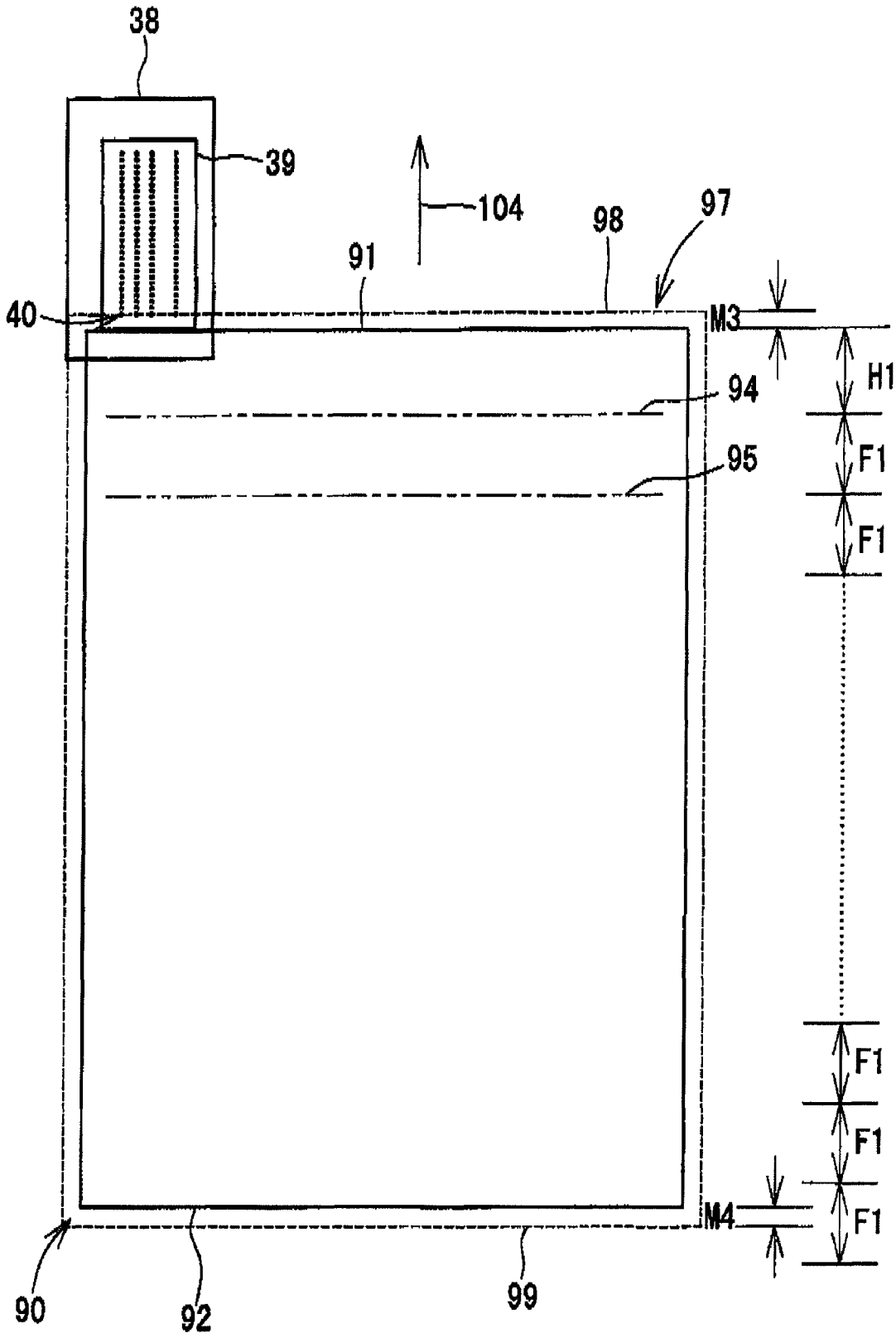
FIG. 9 is a schematic view showing relations among the amount of head poke H1, respective protruding amounts M3, M4 and the target feed amount F1 of the recording sheet in a borderless printing.

More precisely, similar to the above description, prior to the input of the command to initiate the printing operation, from the operation panel 14, a kind and a size of the recording sheet 90, a resolution of a recorded image, margins provided in the recording sheet 90 and a command of the borderless printing are inputted. When the command of the borderless printing is inputted, the respective margins provided on the top end 91, on the bottom end 92 and on opposite sides of the recording sheet 90 cannot be set, so that a recording area 97 that is larger than an area of the recording sheet 90 is set with a predetermined amount of protrusion that protrudes from edges of the recording sheet 90, as shown in FIG. 9. There is disposed a record-initiating position 98 on a downstream side or a top end portion of the recording area 97 in the feed direction 104, and a record-ending position 99 on an upstream side or a bottom end portion of the recording area 97 in the feed direction 104. The borderless printing may be named as "a protruding printing". In the present embodiment, in the borderless printing, a distance or an amount of the protrusion that protrudes from the top end 91 of the recording sheet 90 is referred to as a protruding amount M3, and a distance or an amount of the protrusion that protrudes from the bottom end 92 thereof as a protruding amount M4. The respective protruding amounts M3, M4 may be considered as negative margins.

When the command to initiate the printing operation is inputted from the operation panel 14, the control portion 70 obtains the amount of head poke H1 that is included in the print data, and adjusts the amount of head poke H1 corresponding to the kind information stored in the RAM 73. For example, in a case where the kind information is the kind E in Table 1, the correction rate C of the target feed amount F1 is determined as −1.0%. In this case, a difference GC between a (second) length G of the recording area 97 in the feed direction 104 in a case where the recording sheet 90 is fed by the target feed amount F1 before correction and a (third) length (G+GC) of the recording area 97 in the feed direction 104 in a case where the recording sheet 90 is fed by the target feed amount F2 that is corrected based on the correction rate C (−1.0%, in the present embodiment) is negative. In other words, the length G of the recording area 97 is contracted in the feed direction 104.

The control portion 70 adjusts the amount of head poke H1 corresponding to the correction rate C of the target feed amount F1 in such a manner expressed by the following expression:

$$\text{the amount of head poke } H2=\text{the amount of head poke } H1-\tfrac{1}{2}(\text{the difference } GC)$$

Because the difference GC is negative in the present embodiment, the amount of head poke H1 is increased by a half of the difference GC. Accordingly, the record-initiating position 98 is made closer to the top end 91 of the recording sheet 90 by the half of the difference GC.

Figure 10B:
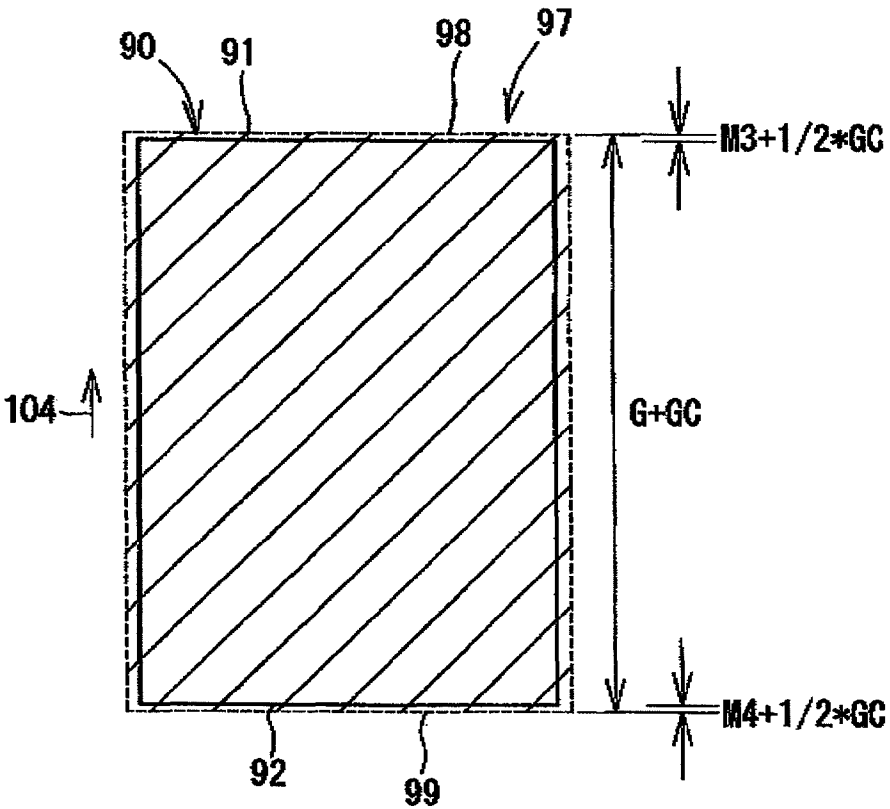
FIG. 10B is a plan view of the recording sheet on which the borderless printing is performed in a case where the correction rate C is negative.
Figure 10A:
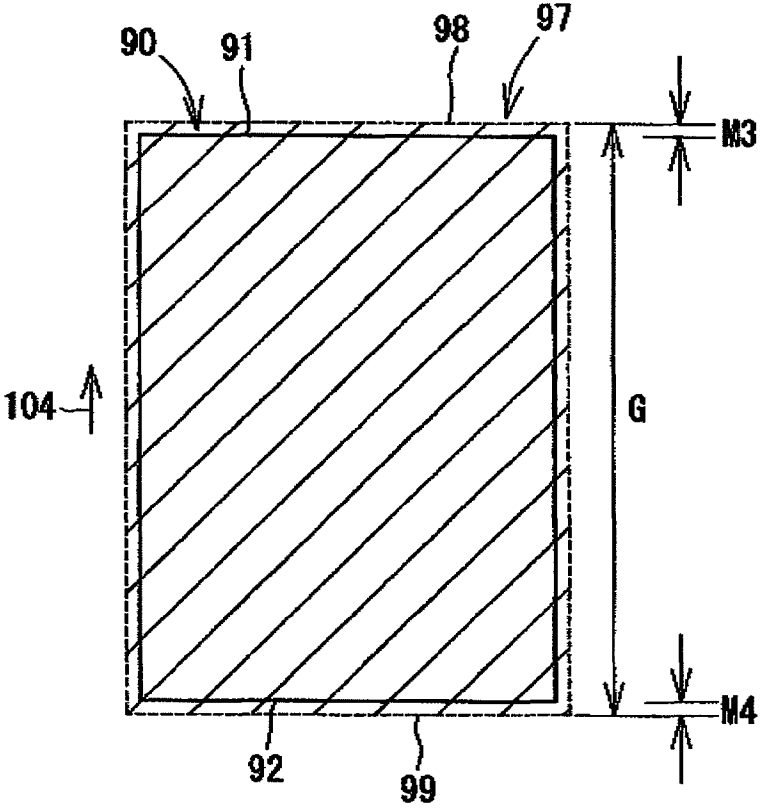
FIG. 10A is a plan view of the recording sheet on which the borderless printing is performed in a case where the correction rate C is 0.

After the amount of head poke H1 is adjusted as mentioned above, the printing operation is performed. In the printing operation, the recording sheet 90 is intermittently fed by the target feed amount F2 that is corrected based on the correction rate C. Therefore, as shown in FIG. 10B, the image is recorded on the recording sheet 90 fed by the target feed amount F2 that is corrected based on the negative correction rate C within the recording area 97 that is contracted by the difference GC in the feed direction 104. Since the amount of head poke H1 is adjusted, the difference GC that is contracted in the feed direction 104 is absorbed or compensated not only by the protruding amount M4 on the bottom end 92 of the recording sheet 90 but also by the protruding amount M3 on the top end 91 thereof. In other words, as the record-initiating position 98 is closer to the top end 91 of the recording sheet 90 by the half of the difference GC, the record-ending position 99 is closer to the bottom end 92 thereof by the half of the difference GC. Therefore, it is prevented that a margin is provided on the bottom end 92 of the recording sheet 90 in spite of the borderless printing.

In the MFD 10 and an image recording method in the present embodiment, because the record-initiating position 93 or 98 is adjusted depending on the correction rate C of the target feed amount F1, the difference GC by which the image of the recording sheet 90 to be recorded is extended or contracted in the feed direction 104 is absorbed or compensated, not only by the margin M2 or the protruding amount M4 that is provided on the bottom end 92 of the recording sheet 90, but also by the margin M1 or the protruding amount M3 that is provided on the top end 91 thereof. Therefore, it is prevented that only the margin M2 on the bottom end 92 is decreased, or that the bottom end portion of the image in the feed direction 104 is not recorded on the recording sheet 90. Further, in the borderless printing, it is prevented that a margin is provided on the bottom end 92 of the recording sheet 90. Accordingly, the banding of the recorded image is restrained, and such problems are solved that, margins or protruding amounts on the recording sheet 90 cannot be controlled and/or the bottom end portion of the image is not recorded.

In the present embodiment, when the control portion 70 adjusts the amount of head poke H1, the difference GO between the image length G that is included in the print data and the image length (G+GC) of the image that is recorded on the recording sheet 90 in a case where the recording sheet 90 is fed by the target feed amount F2 that is corrected based on the correction rate C is adopted. Instead of the image length G, the sheet length L of the recording sheet 90 in the feed direction 104 may be adopted. In this case (embodiment), the sheet length L is used instead of the image length G included in the print data, and a length (L+LC) in which the image length G is replaced with the sheet length L is used instead of the image length (G+GC) of the image that is recorded when the target feed amount F1 is corrected. In this case, the amount of head poke H1 is adjusted in such a manner that is expressed by the following expression:

the amount of head poke $H2$=the amount of head poke $H1-\frac{1}{2}$(the difference $LC$)

For example, in the borderless printing or in a case where the image is recorded on a whole area of the recording sheet 90, the image length G is approximate to the sheet length L of the recording sheet 90, so that a similar effect as mentioned in the illustrated embodiment can be enjoyed even when the image length G is replaced with the sheet length L. Further, since the sheet length L can be easily obtained based on the size of the recording sheet 90 that is inputted from the operation panel 14, a calculation that is made by the control portion 70 when the amount of head poke H1 is adjusted can be simplified, and this results in an improvement of an operation speed. Furthermore, when the copier function and the facsimile-machine function are operated, in a case where the image recording is performed in the printer portion 11 while an image of an original sheet is scanned in the scanner portion 12 or while facsimile-receiving is performed, it is supposed that the image length G of the image to be recorded on the recording sheet 90 in the feed direction 104 has not yet obtained when the image recording is initiated. The embodiment in which the image length G is replaced with the sheet length L is also useful in this case.

In the illustrated embodiment, the control portion 70 determines the correction rate C of the target feed amount F1 based on the kind of the recording sheet 90. However, the correction rate C may be determined based on a characteristic of extension or contraction depending on the kind of the recording sheet 90 or based on a volume of ink that is used in the image recording. For example, an extent of extension or contraction of the recording sheet 90 due to ink permeation differs in not only the kind of the recording sheet 90 but also the volume of ink that is landed on or received by the recording sheet 90. Therefore, the characteristic of extension or contraction is calculated depending on the kind of the recording sheet 90 such as a normal sheet, a coating sheet, the machine-direction oriented sheet, the cross-direction oriented sheet and so forth and is stored in the ROM 72 as the look-up table. The characteristic of extension or contraction is considered as an amount (a length) of extension or contraction of the recording sheet 90 in the feed direction 104 when a predetermined volume of ink is landed on a predetermined area of the recording sheet 90 such as an area corresponding to one pass. In other words, the characteristic of extension or contraction is expressed by the following expression:

the characteristic of extension or contraction=(the amount of extension or contraction in the feed direction 104)/(the volume of ink that is landed on the recording sheet 90 per one pass)

The control portion 70 calculates the amount of ink that is ejected from the recording head 39 during one pass, based on the print data. The control portion 70 then calculates the amount of extension or contraction of the recording sheet 90 corresponding to the one pass, based on the calculated volume of ink per one pass and the characteristic of extension or contraction that is selected based on the kind of the recording sheet 90, and determines the correction rate C per one pass corresponding to the amount of extension or contraction of the recording sheet 90. A relation between the amount of extension or contraction and the correction rate C is previously stored in the ROM 72. Accordingly, in a case where the print data include 100 passes of scanning of the recording head 39, the correction rates C1 through C100 corresponding to each pass are determined. The image length G3 of the image that is recorded based on the target feed amounts F1 per each one pass that are corrected depending on the respective correction rates C1 through C100 corresponds to the third length in the present invention. The control portion 70 adjusts the amount of head poke H1 based on a difference (G3−G) between the image length G3 and the image length G of the image that is recorded on the recording sheet 90 in the case where the recording sheet 90 is fed by the feed amount in accordance with the target feed amount F1. Thus, the target feed amount F1 can be corrected depending on the characteristic of extension or contraction of the recording sheet 90 and the volume of ink, and the amount of head poke H1 can be adjusted corresponding to the correction of the target feed amount F1. The volume of ink may be calculated based on brightness per pixel in the image data that is included in the print data.

What is claimed is:

1. An image recording apparatus, comprising:

a feeding device which is configured to feed a recording medium based on a target feed amount, the recording medium having a first length in a feed direction;

a recording device which is configured to record an image on the recording medium that is fed by the feeding device;

a feed-amount correcting portion which is configured to correct the target feed amount; and a recording-position adjusting portion which is configured to adjust a first position in which an image recording is initiated on the recording medium, corresponding to a correction of the target feed amount by the feed-amount correcting portion, wherein the recording-position adjusting portion is configured to adjust the first position, based on a difference between a second length of the image in the feed direction that is recorded on the recording medium in a case where the recording medium is fed by a feed amount in accordance with the target feed amount and a third length of the image in the feed direction that is recorded on the recording medium in a case where the recording medium is fed by a corrected feed amount which is corrected by the feed-amount correcting portion.

2. The image recording apparatus according to claim 1, wherein an adjusted amount of the first position by the recording-position adjusting portion is a half of the difference between the second length and the third length.

3. The image recording apparatus according to claim 1, wherein the recording-position adjusting portion is configured to calculate the third length based on the first length of the recording medium that is employed instead of the second length.

4. The image recording apparatus according to claim 1, wherein the feed-amount correcting portion is configured to determine a corrected feed amount of the target feed amount based on a kind of the recording medium.

5. The image recording apparatus according to claim 4, further comprising a kind-information receiving portion which is configured to receive a kind information of the recording medium that is fed, wherein the feed-amount correcting portion is configured to determine the kind of the recording medium based on the kind information that is received by the kind-information receiving portion.

6. The image recording apparatus according to claim 1, wherein the feeding device is configured to intermittently feed the recording medium by the target feed amount, wherein the recording device is configured to record the image on the recording medium while feeding of the recording medium by the feeding device is stopped.

7. The image recording apparatus according to claim 1, wherein the recording device is an inkjet type recording device which is configured to record the image on the recording medium by ink droplets.

8. The image recording apparatus according to claim 7, wherein the feed-amount correcting portion is configured to determine a corrected feed amount based on a volume of ink that will be landed on the recording medium.

9. The image recording apparatus according to claim 1, wherein the recording-position adjusting portion is configured to adjust the first position when a bordered printing will be performed in which respective margins are provided on a downstream side and an upstream side of the recording medium in the feed direction.

10. The image recording apparatus according to claim 1, wherein the recording-position adjusting portion is configured to adjust the first position when a borderless printing will be performed in which no margin is provided on a downstream side and an upstream side of the recording medium in the feed direction.

11. An image recording method in which, in a first position that is located in a downstream side of a recording medium in a feed direction, an image recording is initiated on the recording medium that is fed in the feed direction based on a target feed amount and has a first length in the feed direction, wherein the target feed amount is corrected and the first position is adjusted corresponding to a correction of the target feed amount, wherein the first position is adjusted based on a difference between a second length of the image in the feed direction that is recorded on the recording medium in a case where the recording medium is fed by a feed amount in accordance with the target feed amount and a third length of the image in the feed direction that is recorded on the recording medium in a case where the recording medium is fed by a corrected feed amount.

12. The image recording method according to claim 11, wherein an adjusted amount of the first position is a half of the difference between the second length and the third length.

13. The image recording method according to claim 11, wherein the image is recorded on the recording medium by an inkjet printing.

* * * * *